US011436960B2

(12) United States Patent
Jiang

(10) Patent No.: US 11,436,960 B2
(45) Date of Patent: Sep. 6, 2022

(54) SPECIAL-SHAPED DISPLAY SCREEN, SPECIAL-SHAPED PIXEL LIGHT, AND CONTROL METHOD THEREOF

(71) Applicant: Guangzhou Haoyang Electronic Co., Ltd., Guangdo (CN)

(72) Inventor: Weikai Jiang, Guangdong (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 0 days.

(21) Appl. No.: 17/409,482

(22) Filed: Aug. 23, 2021

(65) Prior Publication Data

US 2021/0383734 A1 Dec. 9, 2021

Related U.S. Application Data

(63) Continuation of application No. PCT/CN2021/074039, filed on Jan. 28, 2021.

(30) Foreign Application Priority Data

Jun. 5, 2020 (CN) ..... 202010508143.9

(51) Int. Cl.
*G09G 3/14* (2006.01)
*A63J 5/02* (2006.01)

(52) U.S. Cl.
CPC ..... *G09G 3/14* (2013.01); *A63J 5/02* (2013.01); *G09G 2300/04* (2013.01); *G09G 2310/02* (2013.01)

(58) Field of Classification Search
None
See application file for complete search history.

(56) References Cited

U.S. PATENT DOCUMENTS

2005/0285868 A1* 12/2005 Obinata ..... G09G 5/395 345/539
2018/0075797 A1* 3/2018 Park ..... G09G 3/2092
(Continued)

FOREIGN PATENT DOCUMENTS

CN 201111847 Y 9/2008
CN 101329823 A 12/2008
CN 101329830 A 12/2008
(Continued)

*Primary Examiner* — Aneeta Yodichkas
(74) *Attorney, Agent, or Firm* — Muncy, Geissler, Olds & Lowe, P.C.

(57) ABSTRACT

A special-shaped display screen includes a carrier, and a plurality of pixel point light sources. The plurality of pixel point light sources are provided on the carrier, each of the pixel point light sources is controllable independently, and at least a portion of the pixel point light sources are arranged in a non-matrix array. A special-shaped pixel light includes a special-shaped display screen, a storage unit, and a main control unit. A control method of a special-shaped pixel light includes the following steps: S1, the main control unit establishing a mapping rule according to orientation characteristics of the pixel point light sources; S2, storing the mapping rule into the storage unit; and S3, receiving a control signal and invoking relevant data in the storage unit to scan the pixel point light sources according to the mapping rule.

15 Claims, 4 Drawing Sheets

(56) References Cited

U.S. PATENT DOCUMENTS

| | | | | |
|---|---|---|---|---|
| 2019/0096310 | A1* | 3/2019 | Chen | G09G 3/2003 |
| 2019/0107260 | A1* | 4/2019 | Adema | G09G 3/32 |

FOREIGN PATENT DOCUMENTS

| | | | |
|---|---|---|---|
| CN | 101409032 | A | 4/2009 |
| CN | 101592292 | A | 12/2009 |
| CN | 101763778 | A | 6/2010 |
| CN | 103791321 | A | 5/2014 |
| CN | 104751745 | A | 7/2015 |
| CN | 108154838 | A | 6/2018 |
| CN | 210662637 | U | 6/2020 |
| CN | 212252507 | U | 12/2020 |
| KR | 20160123161 | A | 10/2016 |

* cited by examiner

| | Col1 | Col2 | Col3 | Col4 | Col5 | Col6 | Col7 | Col8 | Col9 | Col10 | Col11 | Col12 | Col13 | Col14 | Col15 | Col16 |
|---|---|---|---|---|---|---|---|---|---|---|---|---|---|---|---|---|
| Row1 | ■ | ■ | ■ | ■ | ■ | ■ | ■ | ■ | ■ | ■ | ■ | ■ | ■ | ■ | ■ | ■ |
| Row2 | ■ | | | | | | | | | | | | | | | |
| Row3 | | | | | | ■ | | | | | | | | | | |
| Row4 | ■ | | | | | | | | | | ■ | | | | | |
| Row5 | ■ | | | | | ■ | | | | | | | | | | |
| Row6 | ■ | | | | | | | | | | | | | | | |
| Row7 | | | | | | ■ | | | | | ■ | | | | | |
| Row8 | ■ | | | | | | | | | | | | | | | |
| Row9 | ■ | ■ | ■ | ■ | ■ | ■ | | | | | | | | | | ■ |
| Row10 | ■ | | | | | | | | | | ■ | | | | | |
| Row11 | | | | | | ■ | | | | | | | | | | |
| Row12 | ■ | | | | | | | | | | | | | | | |
| Row13 | ■ | | | | | ■ | ■ | ■ | ■ | ■ | ■ | | | | | |
| Row14 | ■ | | | | | | | | | | | | | | | |
| Row15 | | | | | | ■ | | | | | | | | | | |
| Row16 | ■ | | | | | | | | | | ■ | | | | | |
| Row17 | ■ | ■ | ■ | ■ | ■ | ■ | | | | | | | | | | ■ |
| Row18 | ■ | | | | | | | | | | | | | | | |
| Row19 | | | | | | ■ | | | | | ■ | | | | | |
| Row20 | ■ | | | | | | | | | | | | | | | |
| Row21 | ■ | | | | | ■ | | | | | | | | | | |
| Row22 | ■ | | | | | | | | | | ■ | | | | | |
| Row23 | | | | | | ■ | | | | | | | | | | |
| Row24 | ■ | | | | | | | | | | | | | | | |

SPECIAL-SHAPED DISPLAY SCREEN, SPECIAL-SHAPED PIXEL LIGHT, AND CONTROL METHOD THEREOF

CROSS REFERENCE TO RELATED APPLICATIONS

The present application is a continuation of International Application No. PCT/CN2021/074039, filed on Jan. 28, 2021, which claims priorities from Chinese Patent Application No. 202010508143.9 filed on Jun. 5, 2020, all of which are hereby incorporated herein by reference.

TECHNICAL FIELD

The present invention relates to the technical field of stage lights, and more specifically relates to a special-shaped display screen, a special-shaped pixel light, and a control method of the special-shaped pixel light.

BACKGROUND

Nowadays, colorful stage lighting provides people with much visual enjoyment, and the pursuit of stage effects drives stage light techniques to progress with each passing day. As a leading role in stage lighting effect, an LED display screen displays videos or image texts through a large area of display screen formed by dot matrix modules or pixel units that are composed of a plurality of light-emitting diodes. With features like vivid colors, a wide dynamic range, high brightness, a long life, stable working performance, strong adaptive capacity to environment, high price performance ratio and a large size, the LED display screens gradually gain a competitive edge over other display media and are widely used at home and abroad.

LED display screens in the prior art are LED matrix display screens, and pixel point light sources on the LED matrix display screen are arranged in a row-column alignment manner. Such display screens have significant limitations in presenting stage visual effects, such as monotonous colors, incapacity to fit light shapes, incapacity to fit appearances of special buildings, and poor performance effects of special-shaped main bodies. Therefore, there is a great need for an LED special-shaped display screen whose shape, size and dimension can be customized as desired by users, and on which the pixel point light sources are not regularly arranged in rows or columns. Compared to LED matrix display screens, such type of LED special-shaped display screens has advantages over many LED matrix display screens, such as richer diversity and stronger flexibility.

In addition, as to a display principle, the LED matrix display screen performs display in a matrix X-Y addressing manner, and reads pixel point light source address data by following a reading rule according to rows or columns. Currently, widely existed video signal processing capability is only applicable to the LED matrix display screens, which obtains light source data by arrangement in the form of original video files or is developed and designed according to characteristics of the LED matrix display screen. Either control method applies only to the LED matrix display screen, and cannot control randomly arranged pixel point light sources of the special-shaped screen.

SUMMARY

The present invention thus provides a special-shaped display screen, a special-shaped pixel light, and a control method of the special-shaped pixel light. The special-shaped display screen can enrich diversity in an area of a display screen. The special-shaped pixel light can break through the limitations in presenting stage visual effects, and has good performance effects of special-shaped main bodies. The control method of the special-shaped pixel light can solve the data reading problem of the special-shaped display screen, and achieves flexibility in handling image and video data of the special-shaped pixel light.

According to the present invention, the special-shaped display screen includes a carrier; and a plurality of pixel point light sources, in which the plurality of pixel point light sources are provided on the carrier, each of the pixel point light sources is controllable independently, and at least a portion of the pixel point light sources are arranged in a non-matrix manner.

The special-shaped display screen of the present invention refers to a specially shaped LED display screen: including a carrier and a plurality of pixel point light sources provided on the carrier, in which the carrier is a PCB board; each of the plurality of pixel point light sources is controllable independently, and each pixel point light source is a color RGB pixel point light source, and at least a portion of the pixel point light sources on the carrier are arranged in a non-matrix array, that is, at least a portion of the pixel point light sources are not regularly arranged in a row-column alignment manner. The special-shaped display screen of the present invention can customize shape, size, and dot matrix density of an LED display screen according to the overall structure and environment of the building in accordance with actual lighting requirements, has a great breakthrough in presenting stage visual effects compared to the LED matrix display screen, can better fit shapes of lights and buildings, has diversified performance effects for special-shaped main bodies, has competitive advantages over the LED matrix display screen, and further enriches the diversity in the area of the display screen.

A plurality of first trend lines and second trend lines are defined according to orientation characteristics of pixel point light sources. The plurality of first trend lines do not intersect with each other and the plurality of second trend lines do not intersect with each other, the first trend lines intersect with the second trend lines, and the special-shaped display screen scans and controls the pixel point light sources according to the first trend lines and the second trend lines.

Since the pixel point light sources on the special-shaped display screen are arranged in a non-matrix array and are not arranged in a conventional row-column alignment manner, the pixel point light sources cannot be scanned and controlled in a conventional row-column scanning manner. Instead, a plurality of first trend lines and second trend lines need to be redefined for the orientation characteristics of pixel point light sources, and the first trend lines and the second trend lines are characterized by: the plurality of first trend lines do not intersect with each other, the plurality of second trend lines do not intersect with each other, and the first trend lines intersect with the second trend lines. The pixel point light sources on the special-shaped display screen extracts mapping addresses of the pixel point light sources according to the defined first trend lines and the second trend lines, and thus the special-shaped display screen is scanned and illuminated combining the displayed contents. Instead of adopting an arrangement in a row-column alignment array, the pixel point light sources on the special-shaped display screen in the present invention design orientation of lines according to an actual application environment. Therefore, scanning the pixel point light sources by extracting mapping addresses of corresponding pixel point light sources through the defined trend lines effectively solves a control, scan and display problem of the special-shaped display screen when the pixel point light sources are arranged.

The carrier includes hollow regions and display regions, in which the hollow region is provided with LED lights, the display region is provided with a plurality of pixel point light sources, and the plurality of pixel point light sources are arranged around the LED lights.

The carrier of the special-shaped display screen in the present invention is provided with hollow regions and display regions. With the provided hollow regions on the carrier in the present invention, a display effect of images is not affected, visual penetrability is achieved and view is not blocked when looked closely, while visual images are completely restored when looked from afar, material costs of the special-shaped display screen are greatly reduced, and maximum utilization of display screen is achieved by using a minimum display area to display images. The hollow regions in the present invention can also be an optical path space of a high-power LED light, and the display region is evenly distributed with a plurality of pixel point light sources surrounded around the LED light. Based on that the pixel point light sources are used as the display screen to display images or videos, the special-shaped display screen can fill the light source effects of the LED light in the hollow regions, such that the LED light is controlled in cooperation with the display screen to present a more diverse variety of stage lighting effects.

The display region includes a plurality of concentric rings having different radiuses, radial straight lines, and line segments, in which the concentric rings are connected as a whole by at least one radial straight line radiating from a center of a circle, the adjacent concentric rings are connected by line segments therebetween, and the number of line segments increases sequentially from the center of the circle.

The whole special-shaped display screen in the present invention structurally has a circular shape consists of two symmetrical semicircular plates, and is specifically formed by a plurality of circular rings, radial straight lines and line segments. The plurality of circular rings are concentric rings having different radiuses that gradually increase from the center of the circle to the outside, the concentric rings are connected as a whole by at least one radial straight line radiating from the center of the circle, the radial line does not pass through the concentric ring having the smallest radius, adjacent concentric rings are connected by a plurality of line segments, and the number of line segments between adjacent concentric rings increases by an arithmetic progression with a tolerance of 6 from the center of the circle to the outside. The present invention forms an integrally circular pixel light by the concentric rings, and a design of multilayer concentric ring satisfies aesthetic properties. In addition, due to linear properties of straight lines and line segments, plus widths for the concentric circular rings are designed to be narrow, after the concentric rings, straight lines and line segments are evenly distributed with pixel point light sources, the pixel light presents a combined image in the form of lines of concentric rings, radial straight lines and line segments, which is clear and simple and can achieve a good performance effect of light patterns.

The concentric rings, radial straight lines and line segments form sectorial ring hollow regions, and the number of sectorial ring hollow regions increases sequentially from the center of the circle.

The present invention divides the carrier into a plurality of identical sectorial ring hollow regions through concentric rings, radial straight lines and line segments, an area of the plurality of hollow regions is larger than that of the display regions, and the number of sectorial ring hollow regions increases by an arithmetic progression with a tolerance of 6 from the center of the circle. The design of the sectorial ring hollow regions in the present invention accords with a curved edge of the concentric ring design. The hollow region allows the pixel light to present patterns with penetrability and does not affect the blocking effect of rear scenery, saves material costs of the light, and does not affect an overall effect of the pixel light. In addition, the hollow regions of the sectorial rings in the pixel light plate have the same size and an even and penetrating capacity to block the rear scenery without generating a partial blocking effect, and achieve an excellent penetrating effect of the pixel light with patterns passing through.

According to the present invention, the special-shaped pixel light includes

- a special-shaped display screen;
- a storage unit, which is used to store single-image data, continuous-image data or dynamic image automatic generation programmed algorithm data; and
- a main control unit, which is used to receive a control signal and invoke the single-image data, the continuous-image data or the dynamic image automatic generation programmed algorithm data to control the pixel point light sources on the special-shaped display screen.

According to the special-shaped pixel light in the present invention, display data corresponding to the pixel point light sources is obtained according to a single image, or a continuous image or a dynamic image, including single-image data, continuous-image data or dynamic image automatic generation programmed algorithm data. Then, the display data is stored in the storage unit, and the main control unit receives the control signal and invokes the display data in the storage unit to scan the pixel point light sources at the corresponding time. The special-shaped pixel light in the present invention mainly includes: a special-shaped display screen, at least a portion of the pixel point light sources on the special-shaped display screen are arranged in a non-matrix array; a storage unit, including a storage medium, such as an SD card and an EPROM element, used to store the single-image data, the continuous-image data, or the dynamic image automatic generation programmed algorithm data, and the stored data supports an offline update or an online update, such as an update using upgrade boxes, an update by writing data from a USB port, an update by writing data through real-time conversion by software, and an update of wireless functions; and a main control unit, which is a chief coordinator of the special-shaped pixel light, receives the control signal through a light control protocol, processes and invokes the data stored in the storage unit to illuminate the pixel point light sources on the special-shaped display screen in order to display images and other information, and mainly has an FPGA and a single-chip microcomputer as core components; the control signal refers to a signal input by a user from a peripheral device, such as brightness, hue, position and change that can characterize a light source, and the light control protocol includes a DMX512 protocol signal or an ARTNET protocol signal or a KINGNET protocol signal. The present invention uses a structure including a storage unit and a main control unit as a powerful support for the special-shaped display screen to display images. Compared to a conventional LED display screen, the special-shaped pixel light achieves a control process for a special display screen, has a great breakthrough in presenting stage visual effects according to an overall structure and environment of a building and features of the special-shaped display screen, has diversified performance effects for special-shaped main bodies, and further enriches diversity in the area of display screen lights.

The storage unit can include a single-image storage unit, a continuous-image storage unit, and a storage unit of a dynamic image automatic generation programmed algorithm, the single-image storage unit is used to store the single-image data, and the main control unit receives the control signal and invokes the single-image data in the single-image storage unit to control the display screen to display the corresponding single image;

the continuous-image storage unit is used to store the continuous-image data, and the main control unit receives the control signal and invokes the continuous-image data in the continuous-image storage unit to control the display screen to display the corresponding continuous multiple images; and the storage unit of the dynamic image automatic generation programmed algorithm is used to store the dynamic image automatic generation programmed algorithm data, and the main control unit receives the control signal and invokes the dynamic image automatic generation programmed algorithm data to control the display screen to display the dynamic image.

For the pixel point light sources on the display screen in the present invention, the storage module correspondingly includes a single-image storage unit, a continuous-image storage unit, and a storage unit of a dynamic image automatic generation programmed algorithm, which respectively store the single-image data, the continuous-image data, and the dynamic image automatic generation programmed algorithm data. The display screen receives the control signal through a display screen control module, and invokes the data in the single-image storage unit, the continuous-image storage unit, or the storage unit of the dynamic image automatic generation programmed algorithm in the display screen to control the display screen to display corresponding contents.

By dividing the pixel point light sources on the special-shaped display screen according to the first trend lines and the second trend lines, the main control unit includes:

a row driver, which is used to scan pixel point light sources located on the first trend lines;

a column driver, which is used to scan pixel point light sources located on the second trend lines; and a controller, which is connected with the row driver and the column driver to receive a control signal and control the row driver and the column driver to scan the pixel point light sources according to single-image data, continuous-image data or dynamic image automatic generation programmed algorithm data.

According to the special-shaped display screen in the present invention, first trend lines and second trend lines are defined for the orientation characteristics of pixel point light sources; the main control unit receives the control signal through the controller and invokes the display data of the pixel point light sources including the single-image data, the continuous-image data or the dynamic image automatic generation programmed algorithm data corresponding to the single image, the continuous image, or the dynamic image, and controls the row driver and the column driver to scan the pixel point light sources in row-by-row and column-by-column manners according to the first trend lines and the second trend lines. In the special-shaped pixel light of the present invention, the pixel point light sources can be scanned using multiple scanning modes, such as row-by-row scanning, interlaced scanning, and multi-region simultaneous/time-sharing scanning. When all of the column drivers output corresponding currents at the same time, single-row control is achieved if only one row is turned on while the other rows are turned off; during each cycle, if each row is sequentially turned on, the row-by-row scanning is achieved, at this time, when each row is turned on, a column driver outputs a current corresponding to the row, and row-by-row single-point control is achieved; when a speed of the row-by-row scanning is fast, single-point control is achieved since human eyes having visual inertia can see that all the light sources are bright. By using the row driver and the column driver to achieve single-point control for each light source and correspondingly output different currents, the present invention characterizes different brightness to be combined together to characterize an image.

The row driver is connected to positive electrodes of all the pixel point light sources on the first trend lines; and the column driver is connected to negative electrodes of all the pixel point light sources on the second trend lines.

In the present invention, negative electrodes of the pixel point light sources are connected to the column driver while the positive electrodes are connected to the row driver, in which the column driver is also referred to as a current controller, the row driver is also referred to as an electronic switch, and the pixel point light sources can be illuminated when the column driver and row driver are simultaneously operated. The present invention electrically connects the positive electrodes of all the pixel point light sources on the first trend lines using the same row driver, electrically connects the negative electrodes of all the pixel point light sources on the second trend lines using the same column driver, and achieves single-point control in a scanning manner. Compared to conventionally using one current controller to separately control a current of one pixel point light source, the present invention uses a current controller to control a column of pixel point light sources, thereby greatly reducing the number of current controllers, effectively saving costs, and increasing scanning rate.

The pixel point light sources arranged in a non-matrix array are anchored to the nearest intersection point of the first trend lines and the second trend lines.

The special-shaped display screen in the present invention may include at least a portion of pixel point light sources arranged in a chaotic manner, for which, in principle, most of the pixel point light sources can fall on the trend lines when defining the first trend lines and the second trend lines, but the chaotic pixel point light sources may not fall on the trend lines. These pixel point light sources that do not fall on the trend lines are offset adsorbed and anchored to the nearest intersection point of the first trend lines and the second trend lines according to a principle of proximity, thereby reaching an objective of enabling all the pixel point light sources to fall on the trend lines and scanning and controlling all the pixel point light sources.

According to the present invention, the control method of a special-shaped pixel light, including a special-shaped pixel light, the method including the following steps:

S1, the main control unit establishing a mapping rule according to orientation characteristics of the pixel point light sources;

S2, storing the mapping rule into the storage unit; and

S3, receiving a control signal and invoking single-image data, continuous-image data or dynamic image automatic generation programmed algorithm data to scan the pixel point light sources according to the mapping rule.

According to the control method of a special-shaped pixel light in the present invention, firstly the main control unit establishes a mapping rule of pixel point light sources according to orientation characteristics of the pixel point light sources, and stores the mapping rule into the storage unit. Then the main control unit invokes the display data of the pixel point light sources including the single-image data, the continuous-image data or the dynamic image automatic generation programmed algorithm data respectively corresponding to the single image, the continuous image, or the dynamic image. Finally, the main control unit uses the controller to receive the control signal and control the row driver and the column driver to scan the pixel point light sources by invoking the display data in order to control the display of the special-shaped pixel light. For pixel point light sources arranged in a non-matrix array, the present invention establishes a set of common mapping rules of pixel point light sources as a theoretical basis for address mapping of a special-shaped pixel light, and proposes a display control method for pixel point light sources of a special-shaped display screen, which has diversified performance effects for special-shaped main bodies and further enriches diversity in the area of display screen lights.

Establishing the mapping rule according to orientation characteristics of the pixel point light sources includes the following steps:

S11, defining a plurality of first trend lines and a plurality of second trend lines according to orientation characteristics of the pixel point light sources, wherein the plurality of first trend lines do not intersect with each other, the plurality of second trend lines do not intersect with each other, and the first trend lines intersect with the second trend line;

S12, performing spatial deformation on all of the pixel point light sources on the first trend lines and the second trend lines to spread into a matrix distribution, straightening and spreading the plurality of first trend lines in a horizontal direction, and straightening and spreading the plurality of second trend lines in a longitudinal direction; and S13, taking the transformed matrix distributed pixel point light sources as the mapping rule for the pixel point light sources.

A step of establishing the mapping rule of the pixel point light sources in the present invention includes: Firstly, defining first trend lines and second trend lines according to the orientation arrangement characteristics of the pixel point light sources on the special-shaped display screen, a plurality of first trend lines do not intersect with each other, a plurality of second trend lines do not intersect with each other, the first trend lines intersect with the second trend lines, and the pixel point light sources fall on the intersection point of the first trend lines and the second trend lines; secondly, performing spatial deformation straightening the first trend lines and the second trend lines to spread into a matrix distribution longitudinally and horizontally, the pixel point light source correspondingly falling on a matrix row-column distribution of the rule, each pixel point light source having a unique physical name, and assigning a logical name corresponding to each pixel point light source after arrangement according to matrix distribution, at which point establishing the mapping rule of all the pixel point light sources is completed. The special-shaped pixel light acquires logical names of the pixel point light sources corresponding to a target image according to the mapping rule of the pixel point light sources, determines the display data of the pixel point light sources, and invokes the display data by receiving the control signal to scan and control the pixel point light sources. The present invention solves an address mapping problem of the special-shaped pixel light on the basis of establishing the mapping rule for the pixel point light sources, thereby controlling the special-shaped pixel light to perform diversified display by scanning the pixel point light sources through light source address mapping.

The control method further includes a step S10 before the step 11:

S10, dividing a special-shaped display screen having regularly arranged pixel point light sources into several identical sub-regions according to a principle of similar arrangement for the pixel point light sources, and establishing the mapping rule for one of the sub-regions, in which other sub-regions have the same mapping rule as one of the sub-regions.

For the pixel point light sources that are arranged regularly and not in a row-column alignment manner, the step S10 is performed prior to the step of defining the first trend lines and the second trend lines: dividing the special-shaped display screen into a plurality of identical sub-regions according to the similar principle, establishing the mapping rule for one of the sub-regions following the next steps, in which other sub-regions have the same mapping rule as the sub-region with the established mapping rule. That is, the mapping rule of the pixel point light sources of the whole special-shaped display screen is obtained by one of the sub-regions, which reduces calculation amounts of the single-chip microcomputer in the special-shaped pixel light and increasing scanning efficiency thereof.

For a case where the trend lines are difficult to be determined according to orientation characteristics of the pixel point light sources, horizontal trend lines and longitudinal trend lines are firstly defined, and then the pixel point light sources are anchored to the nearest intersection point of the horizontal trend lines and longitudinal trend lines according to the principle of proximity.

For a case where the first trend lines and the second trend line are difficult to be defined according to orientation characteristics of the pixel point light sources, the present invention defines horizontal trend lines and longitudinal trend lines using row-column trend lines in matrix distribution, anchors the pixel point light sources to the nearest intersection point of the horizontal trend lines and longitudinal trend lines according to principles of row-column intersection, proximity, and uniform distribution, and then defines a logical name for each pixel point light source using steps of establishing the mapping rule.

In the control method of the special-shaped pixel light, storing the single-image data by the storage unit specifically includes the steps of:

acquiring a physical coordinate set A of LED lights and LED display screen pixel point light sources in one light; placing address mapping on physical coordinate sets A1, . . . An of n lights according to actual positions of each light to obtain a total coordinate set B; intersecting a target image with the total coordinate set B to obtain a target coordinate set C; acquiring optical parameters of the target image corresponding to the target coordinate set C to obtain a set D; dividing the set D into a plurality of subsets D1, . . . Dn according to address mapping by the actual positions of each light, and storing the subsets in the storage unit of the corresponding light.

In the control method of the special-shaped pixel light, storing the continuous-image data by the storage unit specifically includes the steps of:

acquiring a set D for single-frame target images; reading or setting duration t of a single-frame target image; repeating the above steps to acquire a plurality of D and t to form a sequence set denoted as macro M={f (D1, t1), f (D2, t2), . . . )}, and the macro M being named by a numeric index sequence number; storing the plurality of macro M named by the numeric index sequence number into the storage unit; inputting the index sequence number of the macro M in a corresponding channel of a main control unit, and performing a preset action sequence to form a video.

In the control method of the special-shaped pixel light, storing the dynamic image automatic generation programmed algorithm data specifically includes the steps of:

presetting a generation programmed algorithm corresponding to dynamic patterns in the storage unit to cause the LED light control module and/or the special-shaped display screen control module to invoke a generation programmed algorithm by invoking an instruction and control the LED light control module and/or the special-shaped display screen control module to display the dynamic patterns.

Compared with the prior art, the beneficial effects of the present invention are as follows. The present invention provides a special-shaped display screen and a special-shaped pixel light, which can customize shape, size, and dot matrix density of an LED display screen according to an overall structure and environment of a building in accordance with actual lighting requirements, has a great breakthrough in presenting stage visual effects compared to an LED matrix display screen, can better fit shapes of lights and buildings, has diversified performance effects for special-shaped main bodies, and has competitive advantages over the LED matrix display screen. The present invention also provides a control method of a special-shaped pixel light for pixel point light sources arranged in a non-matrix array, which establishes a set of common mapping rules of pixel point light sources as a theoretical basis for address mapping of a special-shaped pixel light, proposes a display control method for pixel point light sources of a special-shaped display screen, has diversified performance effects for special-shaped main bodies, and further enriches diversity in the area of display screen lights.

DETAILED DESCRIPTION

Figure 1:
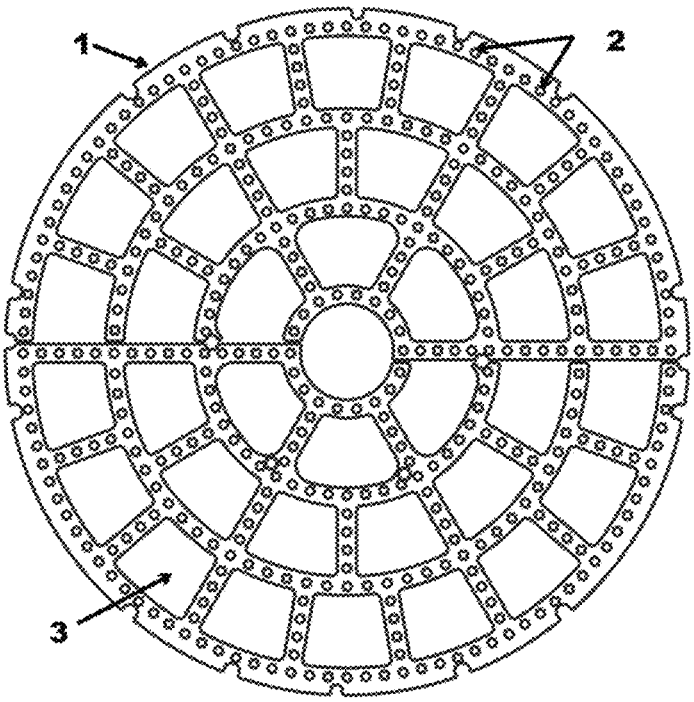
FIG. 1 is a schematic structural diagram of a special-shaped display screen according to the present invention.

The drawings of the present invention are for illustrative purpose only and are not to be construed as limiting the invention. Some components in the drawings may be omitted, enlarged, or reduced for better illustrating the following embodiments, and sizes of these components do not represent sizes of actual products. For those skilled in the art, it will be understood that some known structures and descriptions thereof in the drawings may be omitted.

FIG. 1 shows a structural diagram of a special-shaped display screen according to an embodiment of the present invention, the special-shaped display screen includes:

a carrier 1, and specifically, the carrier 1 is a PCB board; and a plurality of pixel point light sources 2, in which the plurality of pixel point light sources 2 are provided on the carrier, each of the pixel point light sources is controllable independently, at least a portion of the pixel point light sources 2 are arranged in a non-matrix array, and specifically, the pixel point light sources are RGB pixel point light sources, and a portion or all of the pixel point light sources on the carrier are not arranged in a row-column alignment array.

A plurality of first trend lines and second trend lines are defined according to orientation characteristics of pixel point light sources. The plurality of first trend lines do not intersect with each other and the plurality of second trend lines do not intersect with each other, the first trend lines intersect with the second trend lines, and the special-shaped display screen scans and controls the pixel point light sources according to the first trend lines and the second trend lines. Specifically, since the pixel point light sources in the present embodiment are not regularly arranged in a row-column alignment manner, the trend lines are not conventional row-column trend lines, but rather need to be defined according to actual orientation of the pixel point light sources and scan the pixel point light sources according to the defined trend lines in order to illuminate the pixel point light sources.

The carrier 1 includes hollow regions 3 and display regions, in which an area M1 of the hollow regions 3 is larger than an area M2 of the display regions, the hollow region 3 is provided with LED lights, the display region is provided with a plurality of pixel point light sources 2, and the plurality of pixel point light sources 2 are arranged around the LED lights.

The display region includes several concentric rings having different radiuses, radial straight lines, and line segments, in which the concentric rings are connected as a whole by at least one radial straight line radiating from a center of a circle, the adjacent concentric rings are connected by line segments therebetween, and the number of line segments increases sequentially from the center of the circle.

The concentric rings, radial straight lines and line segments form sectorial ring hollow regions, and the number of sectorial ring hollow regions increases sequentially from the center of the circle.

As shown in FIG. 1, the present embodiment of the present invention illustrates a schematic structural diagram of a special-shaped display screen, a special-shaped display screen is not limited to such a special-shaped display screen illustrated in this embodiment, and the special-shaped display screen in the present invention also refers to an irregular display screen in which the pixel point light sources are not arranged in a row-column alignment manner. The special-shaped display screen illustrated in the present embodiment specifically includes a special-shaped display screen carrier 1, which is circular in shape as a whole. The carrier includes display regions and hollow regions 3, an area of the hollow regions is larger than that of the display regions, the display region is formed by four connection portions between concentric rings of different radiuses, and the connection portions and the concentric rings form sectorial ring hollow regions, and when the number of concentric rings from inside to outside is 1, 2, 3, and 4, the number of sectorial ring hollow regions is sequentially 6, 12, and 18. Meanwhile, the display screen carrier in the present embodiment can be an integral circular plate formed by two semicircular plates, thereby saving material costs for replacing components in maintenance. Further, the sectorial ring hollow regions on the special-shaped display screen do not affect the display effect of patterns, and visual penetrability is achieved and view is not blocked when looked closely while visual images are completely restored when looked from afar;

A plurality of pixel point light sources 2 evenly distributed on the display regions include 390 low-power LED pixel point light sources that are distributed in an annular and divergent manner rather than a row-column alignment manner, in which the hollow regions 3 are optical path space of the LED light, and a more diverse variety of patterns or videos can be jointly presented by mounting the LED light for cooperative control with the display screen.

Figure 2:
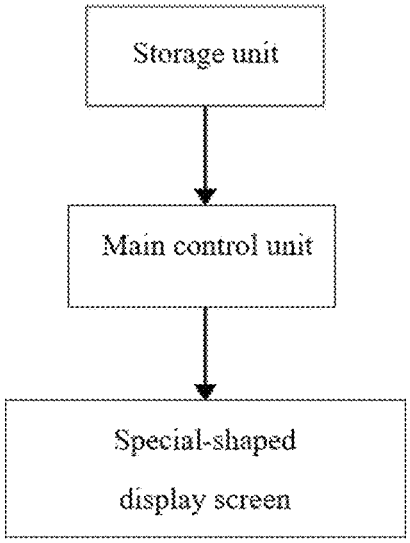
FIG. 2 is a schematic structural diagram of a special-shaped pixel light according to the present invention.

FIG. 2 is a schematic structural diagram of a special-shaped pixel light, according to another embodiment, including:

a special-shaped display screen;

a storage unit, which is used to store single-image data, continuous-image data or dynamic image automatic generation programmed algorithm data; and a main control unit, which is used to receive a control signal and invoke the single-image data, the continuous-image data or the dynamic image automatic generation programmed algorithm data to control the pixel point light sources on the special-shaped display screen.

The storage unit includes a single-image storage unit, a continuous-image storage unit, and a storage unit of a dynamic image automatic generation programmed algorithm, the single-image storage unit is used to store the single-image data, and the main control unit receives the control signal and invokes the single-image data in the single-image storage unit to control the display screen to display the corresponding single image;

the continuous-image storage unit is used to store the continuous-image data, and the main control unit receives the control signal and invokes the continuous-image data in the continuous-image storage unit to control the display screen to display the corresponding continuous multiple images; and the storage unit of the dynamic image automatic generation programmed algorithm is used to store the dynamic image automatic generation programmed algorithm data, and the main control unit receives the control signal and invokes the dynamic image automatic generation programmed algorithm data to control the display screen to display the dynamic image.

By dividing the pixel point light sources on the special-shaped display screen according to the first trend lines and the second trend lines, the main control unit includes:

a row driver, which is used to scan pixel point light sources located on the first trend lines;

a column driver, which is used to scan pixel point light sources located on the second trend lines; and a controller, which is connected with the row driver and the column driver to receive a control signal and control the row driver and the column driver to scan the pixel point light sources according to single-image data, continuous-image data or dynamic image automatic generation programmed algorithm data.

The row driver is connected to positive electrodes of all the pixel point light sources on the first trend lines; and the column driver is connected to negative electrodes of all the pixel point light sources on the second trend lines.

The pixel point light sources arranged in a non-matrix array are anchored to the nearest intersection point of the first trend lines and the second trend lines.

Specifically, a structure of a special-shaped pixel light according to an embodiment of the present invention includes:

a special-shaped display screen;

a LED light; and a storage unit: the storage unit includes a single-image storage unit, a continuous-image storage unit, and a storage unit of a dynamic image automatic generation programmed algorithm, is a storage medium, such as an SD card and an EPROM element, and is used to store image data; the storage unit supports an offline update, an online update, an update using upgrade boxes, an update by writing data from a USB port, a data update by real-time conversion and writing through software after connecting a computer, and an update of wireless functions; and a main control unit: the present embodiment provides corresponding main control units for an LED light and a special-shaped display screen, in which the main control unit of the LED light mainly includes a single-chip microcomputer responsible for processing signals and outputting a PWM signal to an LED driver. The main control unit of the special-shaped display screen includes a row driver, a column driver, and a controller, and mainly has an FPGA and a single-chip microcomputer as core components, in which FPGA has a model of EP4CE10E22C8N, the single-chip microcomputer has a model of STM32F103RCT6. Formed by collectively coordinating the main control unit of the LED light and the main control unit of the special-shaped display screen as one main control unit, the main control unit is a chief coordinator for the main control unit of the LED light and the main control unit of the special-shaped display screen, receives a signal from a peripheral device, processes and schedules a response from the next stage, and outputs the control signal using the DMX512 protocol when the main control unit is integrated on a console.

Figure 3:
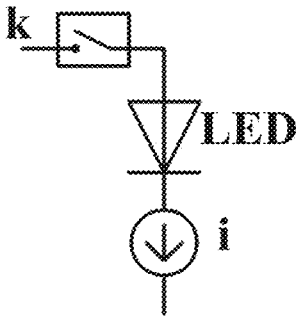
FIG. 3 is a schematic diagram of a control model for a single pixel point light source.

Specifically, a working process of controlling the row driver and the column driver by the controller is as follows. FIG. 3 shows a schematic diagram of a control model for a single pixel point light source, in which k is a row driver of an electronic switch and is connected to a positive electrode of a pixel point light source, i is a column driver of a current controller and is connected to a negative electrode of a pixel point light source, and each pixel point light source includes RGB three primary colors. The present invention achieves single-point control in a scanning manner to save the current controller. Specifically, by connecting the positive electrodes of all the light sources on the same first trend line to the same row driver, connecting the negative electrodes of all the light sources on the same second trend line to the same column driver, and using row-by-row scanning, the column driver outputs a current corresponding to the row when each row is turned on, and thus row-by-row single-point control is achieved. Conventionally, single-point control is performed on a plurality of pixel point light sources, and thus each pixel point light source requires a current controller. The present embodiment greatly saves the current controller by connecting the pixel point light sources on each row and column.

Using the structure of the special-shaped pixel light, a working process of displaying target images and videos on the special-shaped display screen is as follows. First, defining a plurality of first trend lines and second trend lines according to orientation characteristics of the pixel point light sources, the pixel point light sources falling on the intersection point of the first trend lines and the second trend lines, anchoring the pixel point light sources that do not fall on the trend lines by default to the nearest intersection point of the trend lines, and assigning specific logical names for the pixel point light sources by an order of the trend lines; secondly, acquiring the display data of the pixel point light sources corresponding to the target image that needs to be displayed, and storing the logical names of the pixel point light sources and optical parameter data into the single-image storage unit in the scanning order of the trend lines; and finally, the controller in the main control unit driving the row driver and the column driver to scan the pixel point light sources by receiving the control signal and the control instruction to cause the special-shaped display screen to display the target image. By reading or setting duration of a single-frame target image, collecting a multi-frame target image to macro data according to a certain timeline, storing the macro data into the continuous-image storage unit, and retrieving the macro data in the video unit by the main control unit, a process of displaying a video on the special-shaped display screen is achieved.

Using the structure of the special-shaped pixel light, a working process of displaying dynamic patterns on the special-shaped display screen is as follows. Firstly, assigning logical names for the pixel point light sources on the special-shaped display screen; secondly, presetting a programmed algorithm corresponding to a target dynamic pattern, and storing the programmed algorithm corresponding to the target dynamic pattern into the storage unit of the dynamic image automatic generation programmed algorithm; and finally, the controller in the main control unit driving the row driver and the column driver to scan the pixel point light sources by receiving an optical parameter input signal and invoking a program algorithm instruction so as to display the dynamic pattern. When generating spliced dynamic patterns using a plurality of special-shaped pixel light applications, it is desirable to set the relative offset coordinates for each special-shaped pixel light, and recalculate and match the spliced dynamic patterns by combining coordinate offset parameters, such as an effect of radial lines or an effect that water wave diffuses from a center to the outside.

A control method of a special-shaped pixel light according to another embodiment includes the following steps:

S1, the main control unit establishing a mapping rule according to orientation characteristics of the pixel point light sources;

S2, storing the mapping rule into the storage unit; and

S3, receiving the optical parameter input signal and invoking target image data or video data or dynamic pattern data according to the mapping rule to scan the pixel point light sources.

Establishing the mapping rule according to orientation characteristics of the pixel point light sources includes the following steps:

S11, defining a plurality of first trend lines and a plurality of second trend lines according to orientation characteristics of the pixel point light sources, wherein the plurality of first trend lines do not intersect with each other, the plurality of second trend lines do not intersect with each other, and the first trend lines intersect with the second trend line;

S12, performing spatial deformation on all of the pixel point light sources on the intersection point of the first trend lines and the second trend lines to spread into a matrix distribution, straightening and spreading the plurality of first trend lines in a horizontal direction, and straightening and spreading the plurality of second trend lines in a longitudinal direction; and S13, taking the transformed matrix distributed pixel point light sources as the mapping rule for the pixel point light sources.

The control method further includes a step S10 before the step 11:

S10, dividing a special-shaped display screen having regularly arranged pixel point light sources into several identical sub-regions according to a principle of similar arrangement for the pixel point light sources, and establishing the mapping rule for one of the sub-regions, in which other sub-regions have the same mapping rule as one of the sub-regions.

For a case where the trend lines are difficult to be determined according to orientation characteristics of the pixel point light sources, horizontal trend lines and longitudinal trend lines are firstly defined, and then the pixel point light sources are anchored to the nearest intersection point of the horizontal trend lines and longitudinal trend lines according to the principle of proximity.

Figure 4:
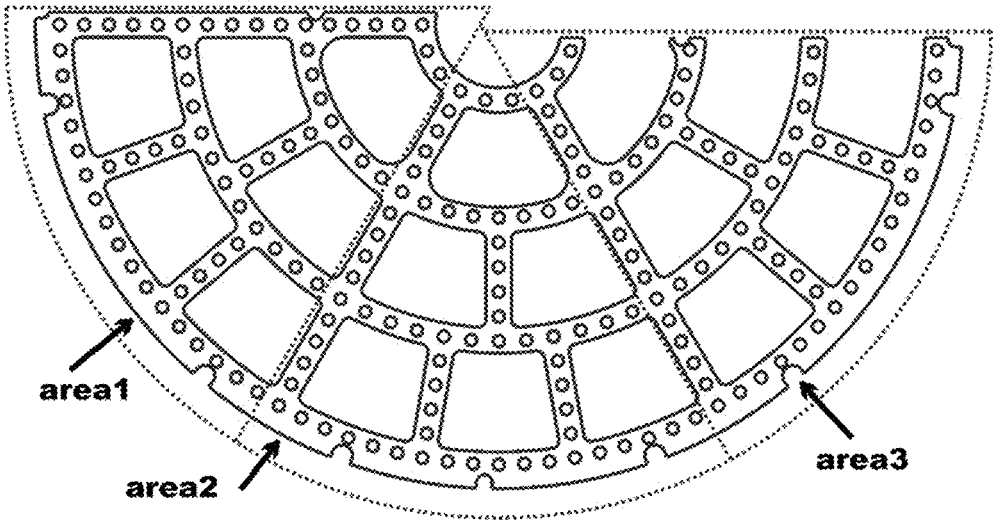
FIG. 4 is a schematic diagram of equally dividing the special-shaped display screen into a plurality of sectors.

Specifically, as shown in FIG. 4, a half of the special-shaped display screen in the first embodiment is equally divided into three sectors. The display screen is equally divided into two halves according to the characteristics of the arrangement rule of the pixel point light sources of a circular special-shaped display screen, and then each half of the display screen is equally divided into three identical sectors, namely area 1, area 2, and area 3, in which each sector includes 65 pixel point light sources, a mapping rule for area 1 sector is established, and the remaining sectors have the same mapping rule as the area 1. Specifically, the establishment of the mapping rule is described in detail using one sector in the special-shaped display screen.

Figures 5, 6:
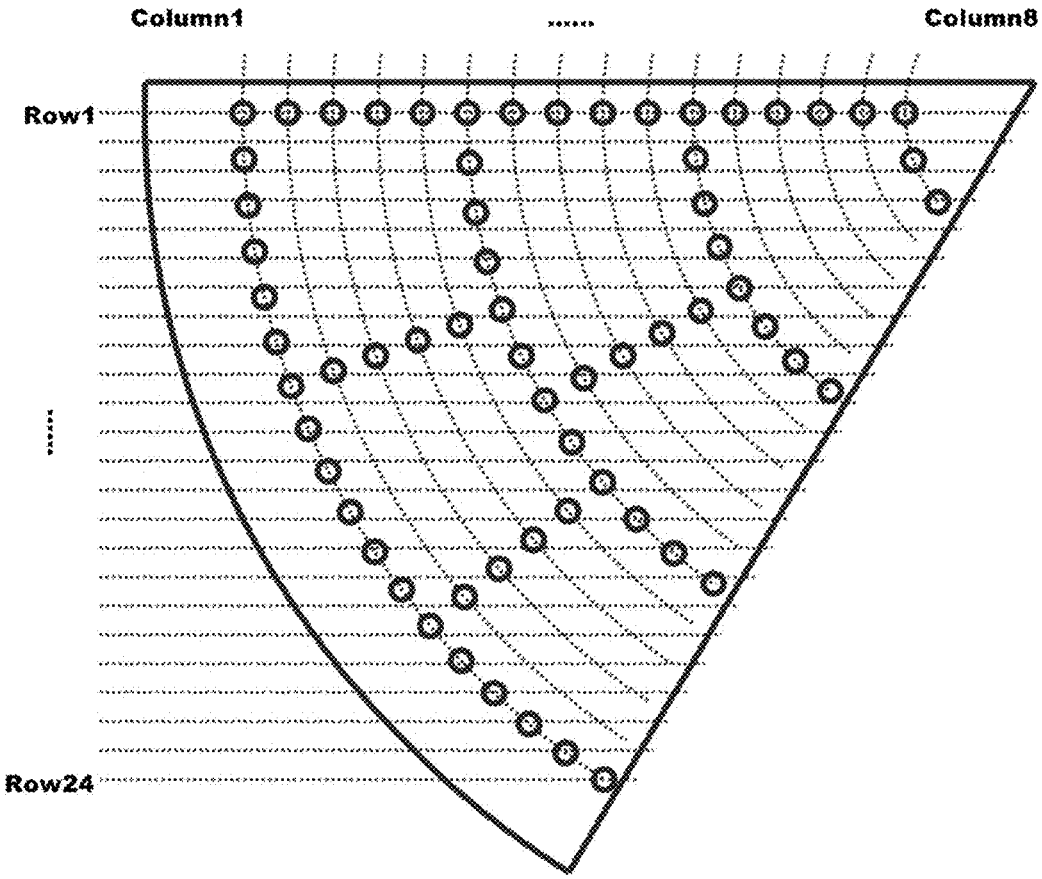
FIG. 5 is a schematic diagram of trend lines defined by the special-shaped display screen.
FIG. 6 is a diagram of a mapping rule.

FIG. 5 shows a schematic diagram of trend lines defined by the special-shaped display screen. A plurality of first trend lines Row and a plurality of second trend lines Column are defined according to orientation characteristics of the pixel point light sources, the plurality of first trend lines Row do not intersect with each other and the plurality of second trend lines Column do not intersect with each other, and the pixel point light sources fall on the intersection point of the first trend lines and the second trend lines. According to the first trend lines and the second trend lines, Column uses a principle of trend line orientation while Row uses principles of row intersection, proximity, and uniform distribution (the uniform distribution principle facilitates neat wiring of circuit boards), and spatial deformation is performed on the first trend lines and the second trend lines to spread into a matrix distribution and obtain a mapping rule graph as shown in FIG. 6. In FIG. 6, black blocks are pixel point light sources distributed in a regular matrix, each pixel having a unique physical name denoted as physics_name={LED, LED2, LED3 . . . }. After distribution is defined in the matrix in the above table, a logical name is generated and denoted as logic_name={R1C1, R1C2, R1C3 . . . }, which means an LED in the first row and the first column, an LED in the first row and the second column, and an LED in the first row and the third column, and the like.

Figure 7:
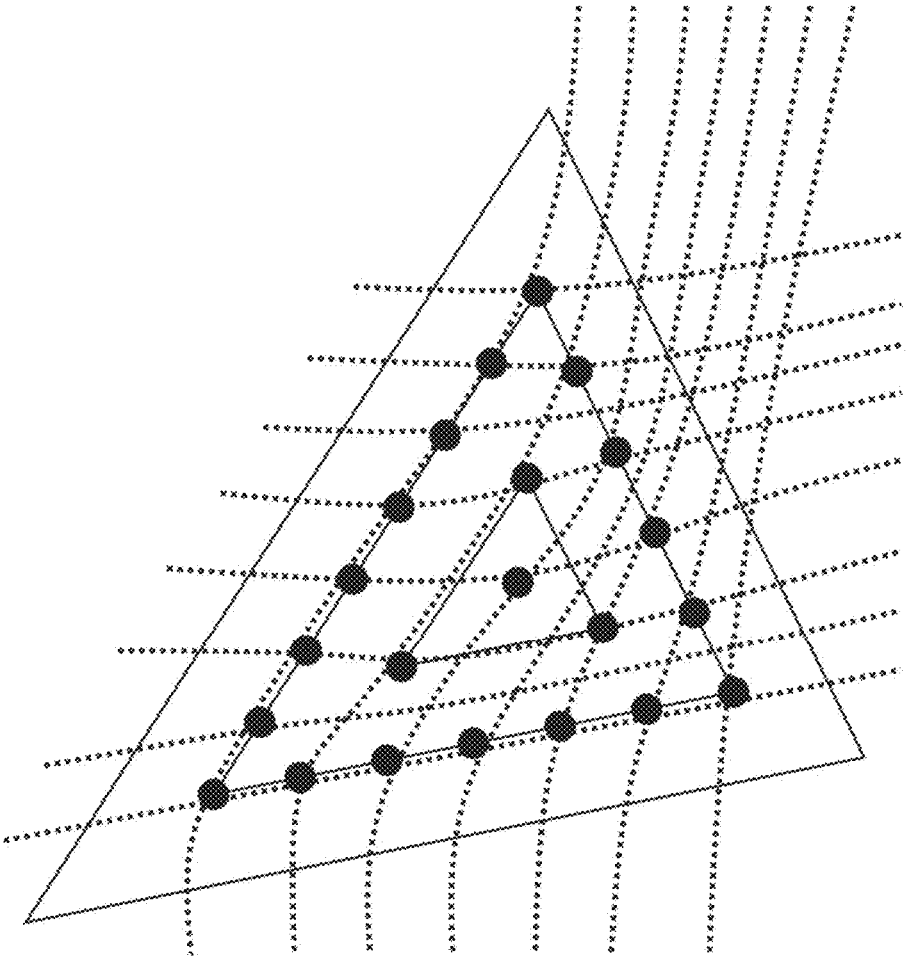
FIG. 7 is another schematic diagram of trend lines defined by a special-shaped display screen.

FIG. 7 shows another triangular special-shaped display screen having irregular arrangement of pixel point light sources. Similarly, according to the method and steps described in the present embodiment, the irregularly distributed pixel point light sources can be divided into 8 rows and 7 columns and can be controlled according to the control method described in the present invention.

Obviously, the above embodiments of the present invention are merely examples for clear illustrating the technical solutions of the present invention, and are not intended to limit the implementation of the present invention. Any modification, equivalent substitution, improvement or the like within the spirit and principle of claims of present invention should be included in the scope of the claims of the present invention.

The invention claimed is:

1. A special-shaped display screen, comprising:

a carrier; and a plurality of pixel point light sources being provided on the carrier, each of the plurality of pixel point light sources being controllable independently, and at least a portion of the pixel point light sources being in form of a non-matrix arrangement, wherein a plurality of first trend lines and second trend lines are defined according to orientation characteristics of the plurality of pixel point light sources, the plurality of first trend lines and second trend lines are configured to perform spatial deformation to spread into a matrix distribution, a transformed matrix distributed pixel point light sources is obtained and taken as a mapping rule to scan and control the plurality pixel point light sources, and wherein the plurality of first trend lines are configured to not intersect with each other, the plurality of second trend lines are configured to not intersect with each other, and the plurality of first trend lines are configured to intersect with the plurality of second trend lines.

2. The special-shaped display screen according to claim 1, wherein the carrier includes a hollow region and a display region, the hollow region is provided with an LED light, the display region is provided with a plurality of pixel point light sources, and the plurality of pixel point light sources are arranged around the LED light.

3. The special-shaped display screen according to claim 2, wherein the display region includes a plurality of concentric rings having different radiuses, radial straight lines, and line segments, the concentric rings are connected as a whole by at least one radial straight line radiating from a center of a circle, the adjacent concentric rings are connected by line segments therebetween, and the number of line segments increases sequentially from the center of the circle.

4. The special-shaped display screen according to claim 3, wherein the concentric rings, radial straight lines and line segments form sectorial ring hollow regions, and the number of sectorial ring hollow regions increases sequentially from the center of the circle.

5. The special-shaped display screen according to claim 1, wherein all of the pixel point light sources on both the first trend lines and the second trend lines are performed spatial deformation to spread into a matrix distribution, by straightening and spreading the plurality of first trend lines in a horizontal direction, and straightening and spreading the plurality of second trend lines in a longitudinal direction.

6. The special-shaped display screen according to claim 1, wherein for a case where the trend lines are difficult to be determined according to orientation characteristics of the pixel point light sources, horizontal trend lines and longitudinal trend lines are firstly defined, and then the pixel point light sources are anchored to the nearest intersection point of the horizontal trend lines and the longitudinal trend lines according to the principle of proximity.

7. A special-shaped pixel light, comprising:

a special-shaped display, which includes a carrier, and a plurality of pixel point light sources being provided on the carrier, each of the plurality of pixel point light sources being controllable independently, and at least a portion of the pixel point light sources being in form of a non-matrix arrangement, wherein a plurality of first trend lines and second trend lines are defined according to orientation characteristics of the plurality of pixel point light sources, the plurality of first trend lines and second trend lines are configured to perform spatial deformation to spread into a matrix distribution, a transformed matrix distributed pixel point light sources is obtained and taken as a mapping rule to scan and control the plurality pixel point light sources, and wherein the plurality of first trend lines are configured to not intersect with each other, the plurality of second trend lines are configured to not intersect with each other, and the plurality of first trend lines are configured to intersect with the plurality of second trend lines;

a storage unit, which is used to store single-image data, continuous-image data or dynamic image automatic generation programmed algorithm data; and a main control unit, which is used to receive a control signal and invoke the single-image data, the continuous-image data or the dynamic image automatic generation programmed algorithm data to control the pixel point light sources on the special-shaped display screen.

8. The special-shaped pixel light according to claim 7, wherein the storage unit includes a single-image storage unit, a continuous-image storage unit, and a storage unit of a dynamic image automatic generation programmed algorithm;

the single-image storage unit is used to store the single-image data, and the main control unit receives the control signal and invokes the single-image data in the single-image storage unit to control the display screen to display the corresponding single image;

the continuous-image storage unit is used to store the continuous-image data, and the main control unit receives the control signal and invokes the continuous-image data in the continuous-image storage unit to control the display screen to display the corresponding continuous multiple images; and the storage unit of the dynamic image automatic generation programmed algorithm is used to store the dynamic image automatic generation programmed algorithm data, and the main control unit receives the control signal and invokes the dynamic image automatic generation programmed algorithm data to control the display screen to display the dynamic image.

9. The special-shaped pixel light according to claim 7, wherein the pixel point light sources on the special-shaped display screen are divided according to first trend lines and second trend lines, the main control unit including:

a row driver, which is used to scan pixel point light sources located on the first trend lines;

a column driver, which is used to scan pixel point light sources located on the second trend lines; and a controller, which is connected with the row driver and the column driver to receive a control signal and control the row driver and the column driver to scan the pixel point light sources according to single-image data, continuous-image data or dynamic image automatic generation programmed algorithm data.

10. The special-shaped pixel light according to claim 9, wherein the row driver is connected to positive electrodes of all the pixel point light sources on the first trend lines; and the column driver is connected to negative electrodes of all the pixel point light sources on the second trend lines.

11. The special-shaped pixel light according to claim 9, wherein the pixel point light sources arranged in a non-matrix array are anchored to the nearest intersection point of the first trend lines and the second trend lines.

12. A control method of a special-shaped pixel light, the special-shaped pixel light including a carrier and a plurality of pixel point light sources being provided on the carrier, each of the plurality of pixel point light sources being controllable independently, and at least a portion of the pixel point light sources being in form of a non-matrix arrangement, wherein the control method comprises the following steps:

S1, establishing a mapping rule according to orientation characteristics of the pixel point light sources by a main control unit, which comprises steps of:

defining a plurality of first trend lines and a plurality of second trend lines according to orientation characteristics of the pixel point light sources, wherein the plurality of first trend lines do not intersect with each other, the plurality of second trend lines do not intersect with each other, and the first trend lines intersect with the second trend line, and performing spatial deformation on the plurality of first trend lines and second trend lines to spread into a matrix distribution, and taking an obtained transformed matrix distributed pixel point light sources as the mapping rule to scan and control the plurality pixel point light sources;

S2, storing the mapping rule into a storage unit; and

S3, receiving a control signal, and invoking single-image data, continuous-image data or dynamic image automatic generation programmed algorithm data to scan the pixel point light sources according to the mapping rule.

13. The control method of the special-shaped pixel light according to claim 12, further comprising performing spatial deformation on all of the pixel point light sources both on the first trend lines and the second trend lines to spread into a matrix distribution, straightening and spreading the plurality of first trend lines in a horizontal direction, and straightening and spreading the plurality of second trend lines in a longitudinal direction; and taking the transformed matrix distributed pixel point light sources as the mapping rule for the pixel point light sources.

14. The control method of the special-shaped pixel light according to claim 12, further comprising:

dividing a special-shaped display screen having regularly arranged pixel point light sources into several identical sub-regions according to a principle of similar arrangement for the pixel point light sources, and establishing the mapping rule for one of the sub-regions, in which other sub-regions have the same mapping rule as one of the sub-regions.

15. The control method of the special-shaped pixel light according to claim 12, wherein for a case where the trend lines are difficult to be determined according to orientation characteristics of the pixel point light sources, horizontal trend lines and longitudinal trend lines are firstly defined, and then the pixel point light sources are anchored to the nearest intersection point of the horizontal trend lines and the longitudinal trend lines according to the principle of proximity.

* * * * *